US006733308B2

(12) United States Patent
Jedlitschka

(10) Patent No.: US 6,733,308 B2
(45) Date of Patent: May 11, 2004

(54) COATING ELEMENT FOR AN ELECTRICAL JUNCTION AND METHOD

(75) Inventor: Hans Jedlitschka, Chatillon (FR)

(73) Assignee: GE Medical Systems Global Technology Company LLC, Waukesha, WI (US)

( * ) Notice: Subject to any disclaimer, the term of this patent is extended or adjusted under 35 U.S.C. 154(b) by 0 days.

(21) Appl. No.: 10/175,653

(22) Filed: Jun. 19, 2002

(65) Prior Publication Data

US 2002/0197908 A1 Dec. 26, 2002

(30) Foreign Application Priority Data

Jun. 20, 2001 (FR) ..... 01 08125

(51) Int. Cl.[7] ..... H01R 4/58
(52) U.S. Cl. ..... 439/86
(58) Field of Search ..... 439/86–91, 521, 439/522, 523

(56) References Cited

U.S. PATENT DOCUMENTS 2,379,942 A * 7/1945 Webber ..... 439/86
3,344,391 A * 9/1967 Ruete ..... 439/86
3,725,846 A * 4/1973 Strain ..... 439/86
4,214,121 A * 7/1980 Charneski et al. ..... 174/84
4,304,616 A 12/1981 Richardson ..... 156/86
4,828,512 A * 5/1989 McCormick et al. ..... 439/495
5,006,286 A * 4/1991 Dery et al. ..... 264/40.2
5,823,802 A * 10/1998 Bartley ..... 439/86

FOREIGN PATENT DOCUMENTS

GB 978606 12/1964

* cited by examiner

*Primary Examiner*—Ross Gushi
(74) *Attorney, Agent, or Firm*—Jay L. Chaskin; David Arnold; Cantor Colburn LLP

(57) ABSTRACT

A coating element for an electrical junction or circuit that reduces surface electric field densities. The coating element comprises a layer of plastic material laden within or in which there is dispersed conductive particles. The coating element surrounds the junction or circuit such that an inner layer or surface of the element is in contact with the outer layer or surface of the junction or circuit. The plastic material may be an elastomer, a polymer, a polyurethane or a silicone. The conductive particles may be a metal powder of aluminum or stainless steel or graphite. The resistivity of the coating element is between about 1 ohm-cm to about 100 kilohm-cm.

33 Claims, 1 Drawing Sheet

COATING ELEMENT FOR AN ELECTRICAL JUNCTION AND METHOD

CROSS-REFERENCE TO RELATED APPLICATIONS

This application claims the benefit of a priority claim under 35 USC 119 to French Patent Application No. 01 08125 filed Jun. 20, 2001, the entire contents of which are hereby incorporated by reference.

BACKGROUND OF THE INVENTION

This invention is directed to the field of electrical circuits, in particular to electrical junctions. More particularly, this invention is directed to high-voltage circuits or junctions, and more specifically to such circuits or junctions as used in radiology. Still further, this invention is directed to a coating element for an electrical circuit or junction.

In high-voltage circuits carrying high voltages on the order of several tens of kilovolts, the parts in the form of points are the site of very high electric field densities. Such densities sometimes lead to a breakdown between the points and ground potential. To avoid breakdown at the points, the points are tipped with balls having a greater radius of curvature than the points thereby substantially reducing the surface density of the electric field per unit area and hence the risk of breakdown is diminished. Such a practice, comprising "rounding" the edges of the junctions, is difficult and costly to implement at all the points of the electrical circuit or junction that may give rise to the breakdown. For the same reason, the diameter of the connecting wires is increased to lessen the electric field density per unit area of the conductor wire. However, the conductors are difficult to handle because of their diameter, and hence costly to manufacture.

BRIEF DESCRIPTION OF THE INVENTION

An embodiment of the invention provides a coating element for an electrical circuit or junction that will substantially diminish the surface electric field density at the periphery of the coating element.

In an embodiment of the invention, the electrical junction is surrounded with a coating element in a plastic material laden or in which there is dispersed conductive particles.

In an embodiment of the invention, the plastic material may be a polymer, an elastomer, a polyurethane or a silicone, and the conductive particles may be a powder of a metal such as aluminum or stainless steel or graphite. In an embodiment of the invention, the electrical conductor material has an electrical resistivity between about 1 ohm-cm and about 100 kilohm-cm.

In an embodiment of the invention, the coating element is yielding so as to adapt to the shape of the electrical circuit or junction.

BRIEF DESCRIPTION OF THE DRAWING

The invention will appear from a reading of the following description of specific examples of embodiments, such description being given with reference to the accompanying drawing, in which.

DETAILED DESCRIPTION OF THE INVENTION

Figure 1A:
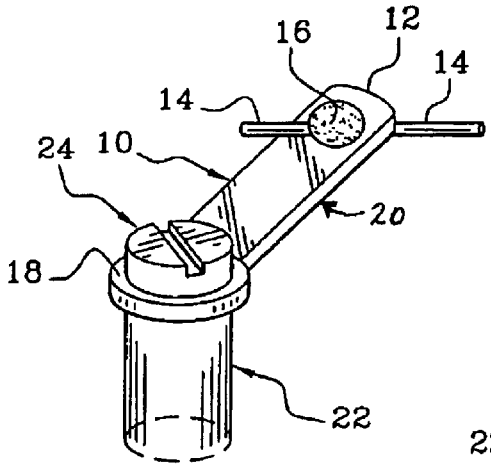
FIGS. 1*a* and 1*b* are diagrams of an assembly (FIG. 1*a*) of a welded electrical terminal mounted on a screw stud and (FIG. 1*b*) surrounded by a coating element.

FIG. 1*a* shows an electrical terminal 10 having a weld at one end 12 to an electrical conductor 14 passing through a hole 16. The other end 18 of the electric terminal 10 is likewise pierced by a hole cooperating with a screw 24 threaded to an electrical stud 22. Such an electrical connection comprises sharp points (ends 12 and 14) and edges 20 having high surface electric field densities.

Figure 1B:
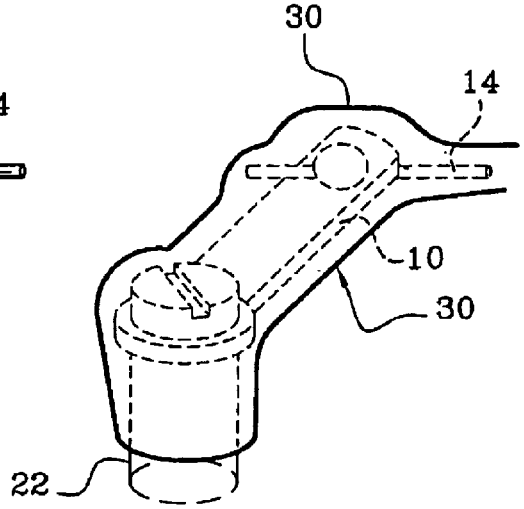

A reduction in the surface electric field densities is provided by a coating element 30 (FIG. 1*b*) in the form of a layer surrounding and enveloping the entire electrical junction of FIG. 1*a* and thus obtaining the coating connection of FIG. 1*b*.

The coating element preferably should have the following properties:

(1) a plastic laden or in which there is dispersed conductive particles, for example, an elastomer, polyurethane or silicone where the conductive particles is, for example, a powder of a metal such as aluminum or stainless steel or graphite or a combination thereof, (2) preferably elastic so as to fit the shape or shapes of the electrical junction and so be in contact with the conductive part thereof;

(3) inert to its environment, comprising, for example, cooling oil and coatings with solid or yielding insulation; and (4) preferably malleable or at least pre-formable.

More specifically, the resistivity should be between about 1 ohm-cm and about 100 kilohm-cm.

Instead of a plastic laden or in which there is dispersed conductive particles, use may be made of a plastic metalized by conventional metalizing processes.

Figure 2:
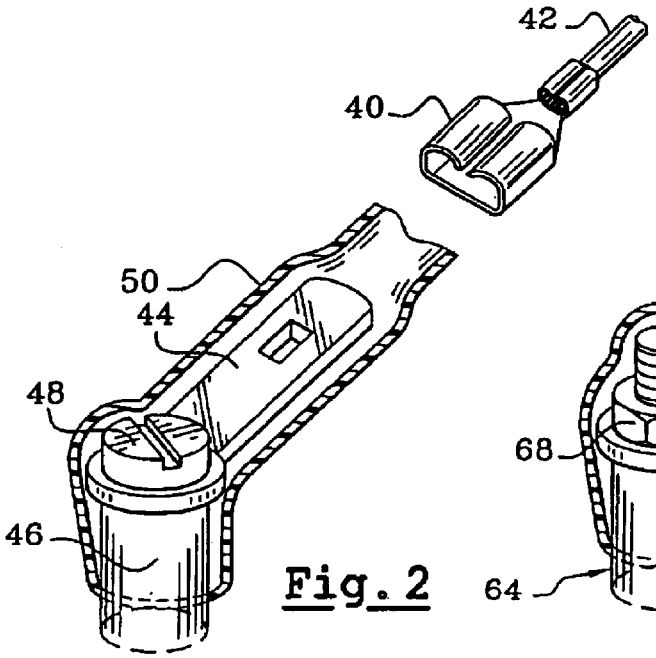
FIG. 2 is a diagram of an assembly of a crimped electrical junction surrounded by a coating element.

The invention is applicable to all types of electrical connections, such as that of FIG. 2 in which a female connector 40 is connected to a conductor 42 fixed on a male connector 44 by sliding, the male connector being fixed to a stud 46 by a screw 48. A coating element may be a sleeve whose inner wall comes into contact with the two connectors 40 and 44 as well as the stud 46 The sleeve may have a conventional shape of different sizes, for example, cylindrical shapes, obtained by simple molding, whose elasticity permits the sleeve to be slipped around the connectors being cabled. For example, tube or sleeves of different diameters made with simple tools with very wide geometrical tolerances. Tubes 66 may extend the end coating elements 30 and 50 of FIGS. 1*b* and 2, covering the open end of a coating element 60 arranged around a crimping connector 62 integral with a stud 64 with a nut 68. Thus the tube 66 will coat a connection conductor 70 connected to the terminal 62.

The coating element preferably comprises an inner wall in contact with the outer wall of the electrical junction of the conductor. The inner wall or surface of the coating element may be in contact with the entire outer wall or surface of the junction or circuit or may be in partial contact. To be effective the coating element is preferably in electrical conducting contact so as to have approximately the same electrical potential as the voltage connection itself. An intermediate layer of any material, for example, insulative or conducting, between the coating element and the outer wall or surface of the electrical junction or circuit is generally unnecessary and therefore can be avoided.

The coating element, when applied, is preferably adapted to the shape of the electrical junction or circuit. This application can be provided, for example, by a shrinkwrap or by heating the element or by forming the element as a split sleeve or by molding about the junction or circuit or by applying a malleable element to fit the external shape of the junction or circuit. This manner of application generally avoids the need to disassemble the junction or circuit and also allows for any complex shape of the junction or circuit.

Various modifications in structure and/or steps and/or function may be made by one skilled in the art to the disclosed embodiments without departing from the scope and extent of the invention as recited in the claims.

What is claimed is:

1. An electrical junction or circuit for use in radiology comprising:

a coating element of a layer of plastic material laden within or in which there is dispersed conductive particles, the coating element having an electrical resistivity of about 1 ohm-cm to about 100 kilohm-cm;

wherein the coating element surrounds the electrical junction or circuit and is in electrical contact with the junction or circuit;

wherein the plastic material is a polymer;

wherein the conductive particles are selected from the group consisting essentially of a powder of stainless steel, a powder of aluminum, a powder of graphite, or combinations thereof; and wherein the coating element reduces an electric field density at a peripheral point of the junction or circuit having a voltage on the order of several tens of kilovolts thereby avoiding a breakdown between the point and ground potential.

2. The junction or circuit according to claim 1 wherein the plastic material is an elastomer.

3. The junction or circuit according to claim 1 wherein the plastic material is a polyurethane.

4. The junction or circuit according to claim 1 wherein the plastic material is a silicone.

5. The junction or circuit according to claim 1 wherein the conductive particles are a metallic powder.

6. The junction or circuit according to claim 1 wherein the plastic material laden within or in which there is dispersed conductive particles which have a resistivity of about at least 1 ohm-cm or greater.

7. The junction or circuit according to claim 1 wherein the plastic material laden within or in which there is dispersed conductive particles which have a resistivity of about at least 100 kilohm-cm or less.

8. The junction or circuit according to claim 1 wherein the plastic material laden within or in which there is dispersed conductive particles which have a resistivity between about at least 1 ohm-cm and about 100 kilohm-cm.

9. The junction or circuit according to claim 1 wherein the plastic material is elastic.

10. The junction or circuit according to claim 1 wherein the plastic material is malleable.

11. The junction or circuit according to claim 1 wherein the coating element has an inner wall or surface in contact with an outer wall or surface of the junction or circuit.

12. The junction or circuit according to claim 1 wherein the coating element has an inner wall or surface in partial contact with an outer wall or surface of the junction or circuit.

13. The junction or circuit according to claim 1 wherein the coating element is at approximately the same electrical potential as that of the junction or circuit itself.

14. The junction or circuit according to claim 1 wherein the coating element is in direct contact with the electrical junction or circuit, absent an intermediate layer of any material, insulative or conductive, between the coating element and an outer wall or surface of the junction or circuit, and absent an additional insulative layer external to the coating element.

15. The junction or circuit according to claim 1 wherein the plastic material is selected from the group consisting essentially of an elastomer, a polymer, a polyurethane or a silicone.

16. The junction or circuit according to claim 15 wherein the conductive particles are a graphite powder.

17. The junction or circuit according to claim 15 wherein the conductive particles are aluminum.

18. The junction or circuit according to claim 15 wherein the conductive particles are a metallic powder.

19. The junction or circuit according to claim 18 wherein the conductive particles are a stainless steel powder.

20. The junction or circuit according to claim 1 wherein the coating element is a sleeve or a tube.

21. The junction or circuit according to claim 20 wherein the plastic material is an elastomer.

22. The junction or circuit according to claim 20 wherein the plastic material is a polyurethane.

23. The junction or circuit according to claim 20 wherein the plastic material is a silicone.

24. The junction or circuit according to claim 20 wherein the plastic material is selected from the group consisting essentially of an elastomer, a polymer, a polyurethane or a silicone.

25. The junction or circuit according to claim 24 wherein the conductive particles are a graphite powder.

26. The junction or circuit according to claim 24 wherein the conductive particles are aluminum.

27. The junction or circuit according to claim 24 where the conductive particles are a metallic powder.

28. The junction or circuit according to claim 27 wherein the conductive particles are a stainless steel powder.

29. A method of reducing surface electric field density of an electrical junction or circuit used in radiology comprising:

a. providing a coating element of a layer of plastic polymer material laden within or in which there is dispersed conductive particles, the conductive particles selected from the group consisting essentially of a powder of stainless steel, a powder of aluminum, a powder of graphite, or combinations thereof, the coating element having an electrical resistivity of about 1 ohm-cm to about 100 kilohm-cm; and b. surrounding the electrical junction or circuit with the coating element.

30. An electrical junction or circuit for use in radiology comprising:

a coating element of a layer of plastic material laden within or in which there is dispersed conductive particles, the coating element having an electrical resistivity of about 1 ohm-cm to about 100 kilohm-cm;

wherein the coating element surrounds the electrical junction or circuit and is in direct electrical contact with the junction or circuit, absent an intermediate layer of any material, insulative or conductive, between the coating element and an outer wall or surface of the junction or circuit, and absent an additional insulative layer external to the coating element; and wherein the coating element reduces the surface electric field density of the electrical junction or circuit relative to ground potential.

31. The junction or circuit according to claim 30 wherein the plastic material is a polymer.

32. The junction or circuit according to claim 31 wherein the coating element reduces an electric field density at a peripheral point of the junction or circuit having a voltage on the order of several tens of kilovolts thereby avoiding a breakdown between the point and ground potential.

33. The junction or circuit according to claim 32 wherein the conductive particles are selected from the group consisting essentially of a powder of stainless steel, a powder of aluminum, a powder of graphite, or combinations thereof.

* * * * *

UNITED STATES PATENT AND TRADEMARK OFFICE

CERTIFICATE OF CORRECTION

PATENT NO. : 6,733,308 B2
DATED : May 11, 2004
INVENTOR(S) : Hans Jedlitschka

Figure 3:
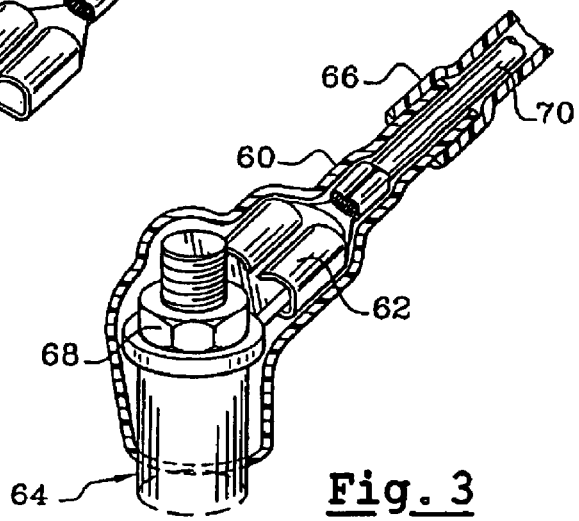
FIG. 3 is a diagram of an assembly showing a coating element in the form of a coating sleeve of a crimped electrical terminal.

It is certified that error appears in the above-identified patent and that said Letters Patent is hereby corrected as shown below:

Column 2,
Line 12, after "and" (first occurrence) delete "14" and insert -- 18 --.
Line 23, after "particles" delete "is" and insert -- are --.
Line 29, after "ductive" delete "part" and insert -- particles --.
Line 51, after "ances." delete "Tubes" and insert -- In FIG. 3, tubes --.
Line 55, after "the" delete "terminal" and insert -- connector --.

Signed and Sealed this

Thirtieth Day of May, 2006

JON W. DUDAS
*Director of the United States Patent and Trademark Office*